US005456496A

United States Patent [19]

Kadish

[11] Patent Number: 5,456,496

[45] Date of Patent: Oct. 10, 1995

[54] LAY-FLAT BOOK BINDING

[75] Inventor: Chester Kadish, Trumbull, Conn.

[73] Assignee: K-Flex, Inc., Madison, Wis.

[21] Appl. No.: 262,236

[22] Filed: Jun. 20, 1994

[51] Int. Cl.[6] ..... B42D 1/00

[52] U.S. Cl. ..... 281/21.1; 281/15.1

[58] Field of Search ..... 412/8; 281/15.1, 281/21.1, 29, 34, 27

[56] References Cited

U.S. PATENT DOCUMENTS

| | | | |
|---|---|---|---|
| 193,036 | 7/1877 | Reynolds . | |
| 402,485 | 4/1889 | Schubert . | |
| 951,436 | 3/1910 | Duryea . | |
| 990,262 | 4/1911 | Hedges . | |
| 998,283 | 7/1911 | Duryea et al. . | |
| 1,224,667 | 5/1917 | Reuter . | |
| 1,570,099 | 1/1926 | Taylor . | |
| 1,602,816 | 10/1926 | Fellows . | |
| 2,014,305 | 9/1935 | Alger | 281/29 |
| 2,121,505 | 4/1937 | Martling | 281/21 |
| 2,182,801 | 12/1939 | Frazier | 281/21 |
| 3,437,506 | 4/1969 | Falberg | 117/44 |
| 4,299,410 | 11/1981 | Jukola | 281/21 |
| 4,547,000 | 10/1985 | Sallinen | 281/23 |
| 4,650,216 | 3/1987 | Carlson | 281/34 |
| 4,911,475 | 3/1990 | Lerman | 281/15.1 |
| 5,078,424 | 1/1992 | Kadish | 281/21.1 |
| 5,154,447 | 10/1992 | Tooker | 281/21.1 |
| 5,183,294 | 2/1993 | Jukola et al. | 281/23 |

FOREIGN PATENT DOCUMENTS

| | | | |
|---|---|---|---|
| 3511646 | 9/1986 | Germany | 412/8 |
| 490869 | 2/1954 | Japan . | |

*Primary Examiner*—Willmon Fridie, Jr.
*Attorney, Agent, or Firm*—Lathrop & Clark

[57] ABSTRACT

The paperback book of this invention has a book block with a plurality of sheets joined together at their spine edges. The book also has a stiff cover. A flattened woven tubular ribbon with tabs which is glued to the cover and the book block is glued to the ribbon. The tubular ribbon has tabs which extend continuously along the length of the ribbon and are 180 degrees apart on the outside circumference of the ribbon. The tabs thus divide the outside circumference of the ribbon into two regions. A first outside region of the ribbon is fastened by an adhesive to the inner spine portion of the cover and the surfaces of the tabs which extend from the first region are fastened by the adhesive to the inside surface of the cover adjacent to inner spine portion of the cover thus reinforcing the attachment of the cover to the spine. Adhesive also attaches the back of the book block at a second section of the outside circumference opposite the first section of the tubular ribbon. The first and second sections of the tabbed tubular ribbon are joined only where they join the tabs. Hence the book has a book block which is fully attached to the cover yet which is fully free to flex.

6 Claims, 2 Drawing Sheets

LAY-FLAT BOOK BINDING

FIELD OF THE INVENTION

This invention relates generally to the field of books and book binding and to paperback book bindings and methods for paperback binding in particular.

BACKGROUND OF THE INVENTION

Paperback books am commonly formed by the process of perfect binding wherein the individual sheets or leaves of a book are assembled and held together by a backbone adhesive, usually a hot melt glue, applied to the spine edges of the leaves to form a book block. The same adhesive which joins the sheets into a book block usually attaches the book block to the inner spine of a stiff paper cover. Paperback books may be produced according to this common method with efficiency and low cost; however, because the book block is affixed along the length of its back to the stiff paper cover the sheets of the book are not free to open fully and the pages in a spread will not lie flat. Books to be used as instruction manuals, cookbooks, workbooks, or textbooks should be readable without the need for the reader to place his hands on the book, so that he may carry on other tasks with his hands while reading the book. Furthermore, because of the stiffness of the spine of the book, when the book is opened a deep depression or "V" is formed at the binding. This deep "V" makes it difficult to read the printing at the inner margins of the bound pages.

A book binding is disclosed in U.S. Pat. No. 951,436 to Duryea which employs a tubular binding formed by adhesively overlapping an elongated piece or strip of pliant flexible material disclosed by Duryea as tough paper, muslin, or the like. However, a tube of ordinary flexible material such as paper or muslin may lack the strength and glue adhesion needed to durably bind the book block to the cover in a commercially acceptable manner. The disclosure of U.S. Pat. 998,283 to Duryea et al. recognizes this by providing additional strength to the binding of U.S. Pat. No. 951,436 by having lateral extending portions from the sides of the tubular book bindings which are glued between the back cover and the end sheets of a book. The tubular book bindings of the Duryea patents are not in widespread use. To be practical, a tubular binding requires a durable and flexible material exhibiting substantial tensile strength and while Duryea et al may have considerable strength, its construction is complicated and if manufactured of cost effective paper the binding requires reinforcing at the ends of the book binding to resist tearing.

An attribute of most previous materials employed for tubular bindings is a tendency for the glue which is used to attach the tubular binding to the back of the book block and to the spine of the book cover to render the tubular material inflexible and brittle such that when the bound book is opened the glue in the area along the hinges between the cover and the book block cracks and breaks the material of the tube.

U.S. Pat. No. 4,547,000 to Sallinen teaches a method of overcoming the glue saturated embrittlement of the tubular binding by wrapping the tubular binding around the side of the book back and leaving the portions so wrapped free of glue to form flexible hinges. Leaving these hinge areas unglued, however, involves additional cost and complexity in manufacturing. Sallinen discloses a tubular binding using some elastically flexible material such as plastic or crepe which is nonpenetrable by glue. The commercial embodiment of the Sallinen invention utilizes paper or paper reinforced with gauze mesh, both materials which must be kept glue free to remain flexible.

Another method for producing paperback bindings which allows the bound pages to lie flat is known which attaches the book block to a flexible crepe capping which provides support for the sheets of the book block but which is not directly attached to the spine of the cover, rather the book block is attached to the cover by stripes of glue affixing the first and last sheets of the book block to the stiff paper cover on either side of the cover's spine. Thus the entire weight of the book block is carded on only a small portion of a ribbon and two sheets of paper. Furthermore, this method requires that a portion of the first and last pages of the book block be given over to adhesive purposes.

Another problem which afflicts paper books is the tendency of the cover to become detached or to peel away from the book block or pages.

What is needed is a paperback binding which would leave the book block free to bend, allowing the book to lie flat when opened, yet which also resists separation of the cover and is simple to manufacture.

SUMMARY OF THE INVENTION

The paperback book of this invention has a book block with a plurality of sheets joined together at their spine edges. The book also has a cover. A flattened woven tabbed tubular ribbon, preferably of yarn formed from polyester filaments, has interwoven warp yarns and filling yarn which present interstices for reception of glue. The ribbon has first and second longitudinally extending tabs which are integrally woven with the tubular ribbon. The tabs extend continuously along the length of the ribbon and are 180 degrees apart on the outside circumference of the ribbon. The tabs thus divide the outside circumference of the ribbon into two regions. A first outside region of the ribbon is fastened by a first adhesive to the inner spine portion of the cover and the surfaces of the tabs which extend from the first region are fastened by the first adhesive to the inside surface of the cover adjacent to inner spine portion of the cover. Hinge lines are defined between the book back and the cover where the cover opens away from the spine of the book. The tabs extend across the hinge lines on to the cover of the book.

A second adhesive attaches the back of the book block at a second section of the outside circumference opposite the first section of the tubular ribbon. The tabs, however, are not glued to the book block. Thus the connection across the hinge line of the book to the binding is reinforced by the tabs but free to open. Because the first and second sections of the tabbed tubular ribbon are joined only where they in turn join the tabs of the book, the book block is fully attached to the cover yet is fully free to flex.

It is an object of the present invention to provide a tabbed tubular binding for a book which has superior strength in affixing the book block back to the spine of the cover.

It is an additional object of the present invention to provide a paperback book binding which provides flexibility to the spine of the book block while providing a durably mounted cover.

It is an additional object of the present invention to provide a case bound binding which will open substantially flat.

It is also an object of the present invention to provide a method of making a plurality of paperback books in an efficient and cost effective manner by the use of a woven tabbed tubular ribbon binding which may be applied in a continuous manner to join a plurality of book blocks to the spines of the book covers.

It is a further object of the present invention to provide a ribbon binding which can accommodate book block backs of varying widths with a fixed width ribbon.

It is a still further object of the present invention to provide a woven tabbed tubular binding which reinforces the joint between the book block and the cover.

Further objects, features, and advantages of the invention will be apparent from the following detailed description when taken in conjunction with the accompanying drawings.

DESCRIPTION OF THE PREFERRED EMBODIMENT

Figure 1:
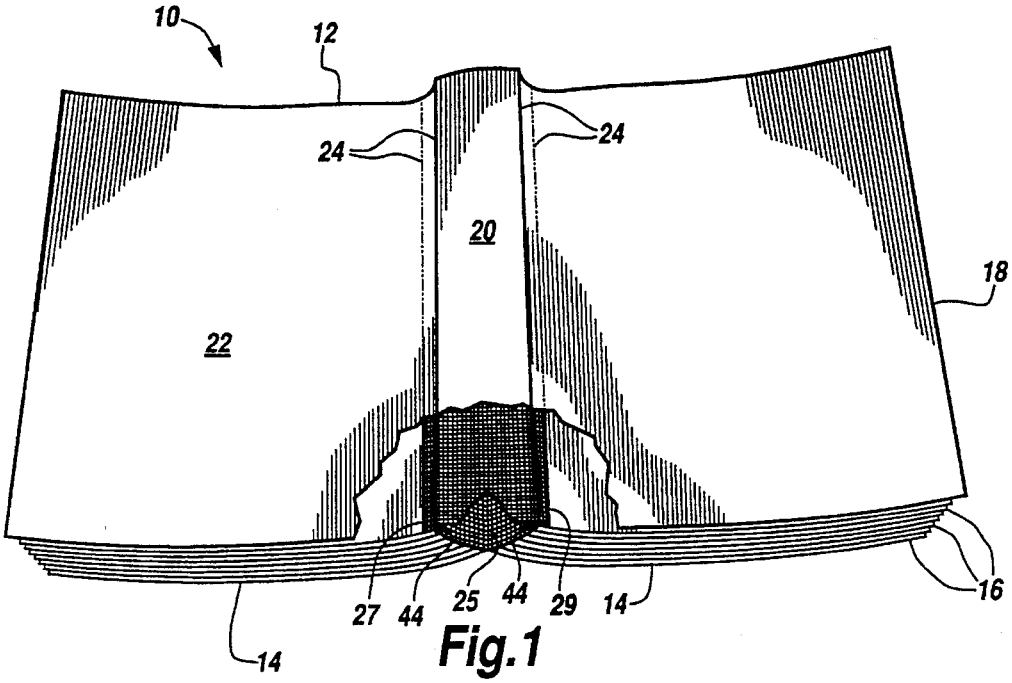
FIG. 1 is a partial cut-away view of the spine of the paperback book of the present invention with a portion of the tabbed tubular ribbon cut away.

Referring more particularly to FIGS. 1–5, wherein like numbers refer to similar parts, a paperback book 10, as shown in FIG. 1, has a cover 12 which is affixed to a book block 14. The book block is formed by assembling individual sheets 16 of the book and affixing the spine edges of the sheets 16 together by applying an adhesive. The book block 14 may be prepared in a conventional manner on a typical binding line. The necessary sections, signatures, or sheets are collated to form the book block 14. The blocks are inserted into moving clamps which pass over saws, mills, knives, and brushes as needed to prepare the spine for gluing.

The book block 14 is formed by applying a flexible hot melt glue such as Croda #10-24-5 or a flexible PUR adhesive such as Fuller NP-2062 to the back of the book block.

Alternatively, several types of glue may be applied to the book block. For example, first an aqueous primer glue may be applied to the back 32 of the book block with rollers or an extrusion applicator. The book block may then be carried over a heated chamber to allow the glue to penetrate the back and to remove moisture. In the multiglue process, a flexible hot melt glue may then be applied with rollers to the back of the book block over the previous applied primer.

The cover 12 is a folded sheet of stiff paper stock having a front cover 18, a back cover 22, and a spine 20 which extends between the front cover and the back cover. Crease or scoring lines 24 may be provided on the front and back covers 18, 22 to facilitate opening of the covers. This scoring may be the normal scoring conventionally used in the perfect binding system.

Figure 2:
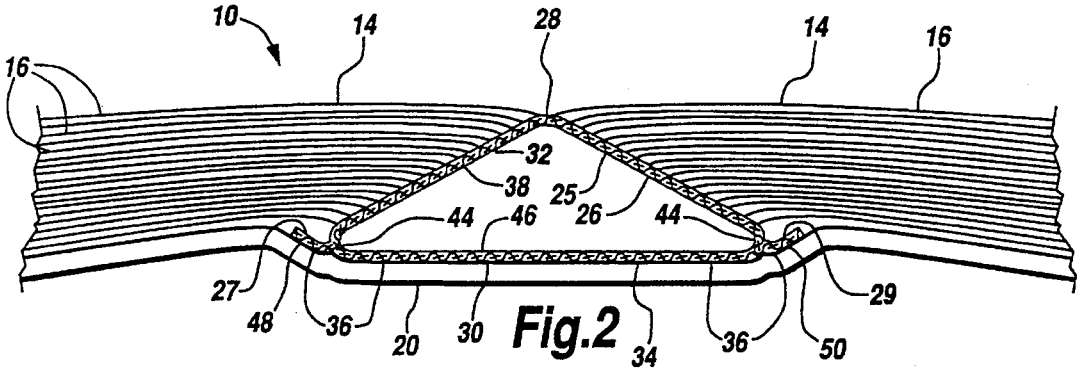
FIG. 2 is an enlarged somewhat diagrammatic fragmentary end view of the opened book of FIG. 1.

The cover 12 is affixed to the book block 14 by means of a woven tubular ribbon 26, best shown in FIGS. 1 and 2. The tubular ribbon 26 has a central tubular section 25 and opposed tabs 27, 29. The tabs 27, 29 are integrally woven with the tube 25 to form an integral structural cloth tube. A woven tubular ribbon with tabs, as defined herein, is a ribbon tube with integral opposed tabs which arc woven as a continuous article; the tube 25 and the tabs 27, 29 arc not formed by gluing or sewing the structure of the tube together. The result of the integral woven structure of the tubular ribbon 26 is that the tabs 27, 29 are flexibly but strongly joined to the circumferential sections 28, 30 of the tubular portion 25 of the ribbon 26. The ribbon 26 is a flexible, continuous article of woven yarns which when brought in contact with the cover 12 and the book block 14 is flattened to define a first circumferential section 28 and a second circumferential section 30, with the tabs 27, 29 being integrally woven into the juncture of the circumferential sections 28, 30. The tubular ribbon 26 has a tubular section 25 which when flattened is preferably substantially as wide as the book block 14 is thick.

Figure 3:
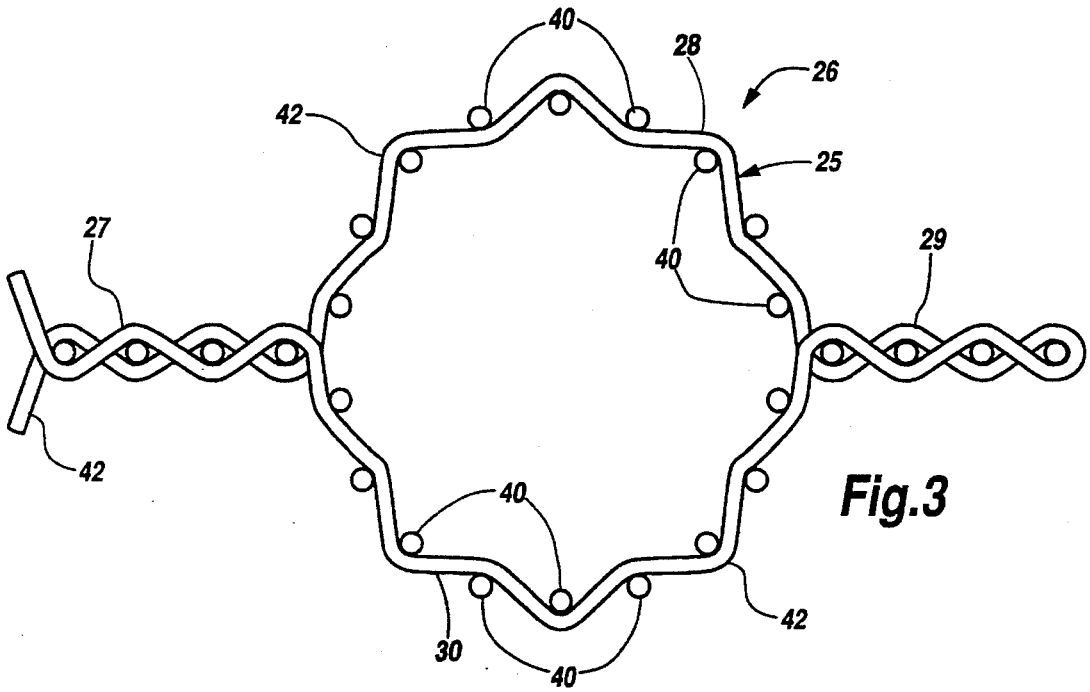
FIG. 3 is a schematic cross-sectional view of the woven tabbed tubular ribbon of the book of FIG. 1.
Figure 4:
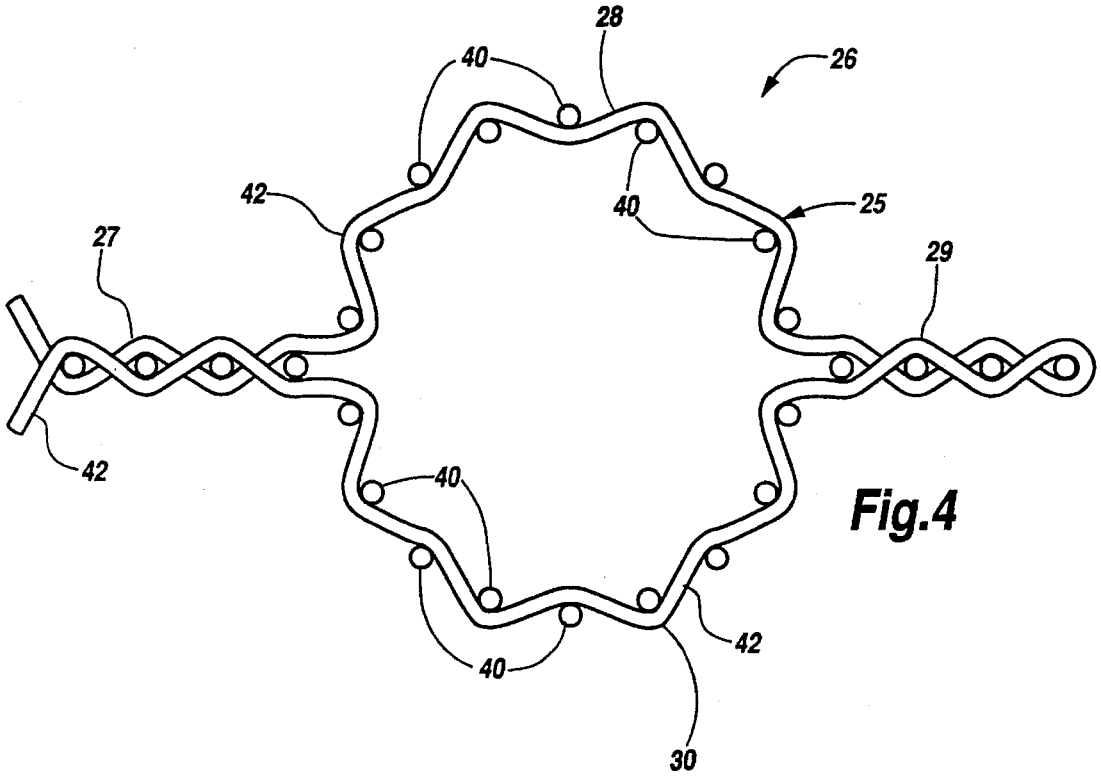
FIG. 4 is a schematic cross-sectional view the woven tabbed tubular ribbon of FIG. 3 taken directly behind the section of FIG. 3.

The construction of the ribbon 26 is schematically illustrated in FIGS. 3 and 4. Filling yarns 42 arc woven about warp threads or ends 40 which arc arrayed in two dimensions as illustrated in FIGS. 3 and 4. The filling yarn 42 is continuous from the tab 27 around the second circumferential section 30 around the tube 25 to the second tab 29 and back around the opposed first circumferential section 28 to the first tab 27. FIG. 4 illustrates the next sequential filling yarn 42. As is apparent from FIGS. 3 and 4, the density of the filling yarns 42 will be twice as dense in the tabs 27, 29 as in the tube 25 of the ribbon 26.

Figure 5:
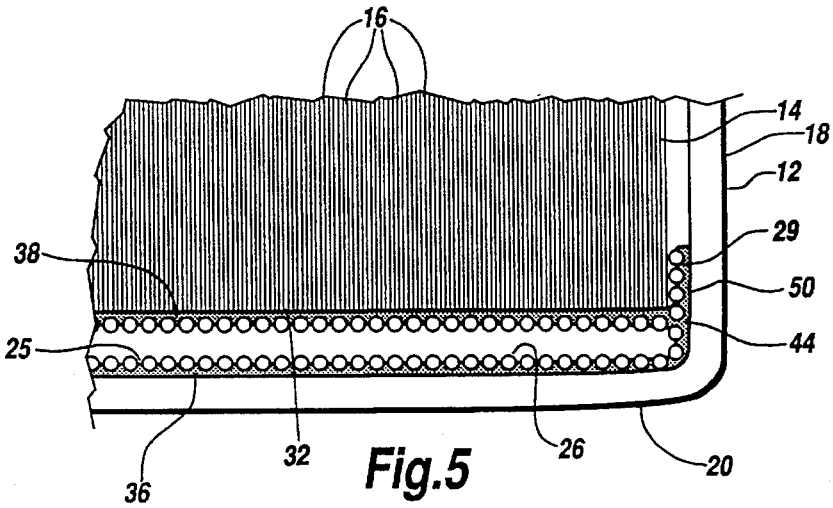
FIG. 5 is a schematic side view of a portion of the adhesively attached woven tabbed tubular ribbon of the book of FIG. 2 where the cover of the book is closed.

The ribbons shown in FIGS. 3, 4 and 5 are schematic in nature. Tubular ribbons used in a particular application may vary in number of yarns and dimensions. A tabbed tubular ribbon suited for use in the book binding of this application would be one such as those obtainable from C. M. Offray & Sons, Inc., Rt. 24, Box 601, Chester, N.J. 07930-0601, pattern numbers 70-5518 and 70-5528 consisting of the following specification:

A narrow ribbon with a tubular center with single cloth tabs on each side consisting of a 1×1 plain weave tubular construction with single cloth tabs of 2×2 pointed or herringbone twill on each side of the tube. The warp (series of longitudinal yarns) is made of 70 denier filament polyester. The filling (series of crosswise yarns) is made of 70 denier textured filament polyester. The catch cord is 25 dtex monofilament polyester. The warp has a density of 203 ends (warp yarns) per inch in the tube and 56 ends per inch in the tabs. The filling has 100 picks (filling yarns) per inch, which gives the effect of 50 picks per inch in each layer of the tube and 100 picks per inch in the tabs.

As illustrated in FIGS. 2 and 5, the first circumferential portion 28 of the ribbon 26 is glued to the back of the book block 32 and the second circumferential portion 30 is glued to the inside spine 34 of the cover 12. The tabs 27, 29 arc thus positioned adjacent to hinge lines 44, shown in FIG. 2, which are defined where the book block 14 is joined to the front cover 18, and the back cover 22. Adhesive 36 joins the second circumferential section 30 to the inside 34 of the spine 20. The tabs 27, 29 are also joined by the adhesive 36 to portions 48, 50 on the inside of the cover 12. These portions 48, 50 where the tabs 27, 29 bond to the inside of the cover 12 are opposite the creases 24 illustrated in FIG. 1 and can serve to reinforce this area of the book binding. The critical function, however, performed by the tabs 27, 29 is to more securely fasten the block 14 to the cover 12. The tabbed tubular ribbon 26 takes advantage of the difference between peel strength of the adhesive 36 and its tensile strength. A well known engineering limitation of adhesives is that, although they can readily be formulated with high tensile and high shear strength, the achievable peel strength is quite limited. Thus a book binding which avoids forces which peel the book block or binding away from the cover is highly desirable. As illustrated in FIG. 2, the book block 14 is attached to the cover 12 along hinge lines 44. In a tubular binding the weight of the book block tends to peel the binding away from the cover along the hinge lines.

The desirability of reinforcing the binding hinge areas has long been known. For instance, U.S. Pat. No. 998,283 to Duryea, et al. teaches the use of reinforcements of muslin or other suitable material which form tabs which extend away from a tubular binding reinforcing the hinge lines. However, because the tabs of Duryea are in turn glued to the tube, the possibility of the tabs peeling away from the tube is evident. The tabbed tubular ribbon 26 of the present invention overcomes this problem with a unitary construction of the tube which eliminates the use of adhesives in forming the tabbed tube 26 itself. Thus the first circumferential section 28 of the ribbon 26, which is bonded by the adhesive 38 to the back of the book block 32, is joined to both the tabs 27, 29 and the second circumferential section 30 by continuous filling yarns 42 as shown in FIGS. 3 and 4. The second circumferential section 30 is bonded by glue 36 to the inside of the spine 34, and the tabs 27, 29 are bonded by glue 36 to spine portions 48, 50 which underlie the tabs 27, 29. Thus the weight of the book block 14 is transmitted through the hinged portions 44 of the tubular ribbon 26 to apply a tension force to the glue 36. The result of the weight of the book block 14 pulling away from the cover 12 rather than peeling away from the cover 12 can be an order of magnitude or more in the strength of the binding produced by the tabbed tubular ribbon 26. Thus the problem of other bindings which rely on the limited peel strength of binding glue is overcome.

The attachment of the second circumferential section together with the tabs 27, 29 to the inside of the spine 34 and the adjacent portions underlying the tabs 48, 50 is preferably accomplished with a hot melt adhesive such as Croda #10-24-5, alternatively an aqueous adhesive, animal adhesives or other appropriate adhesives may be used. One or more layers of adhesives may be employed. The adhesives should not penetrate the ribbon so that the first circumferential section 28 and the second circumferential section 30 are not attached to each other, thus the inside circumference 46 of the tubular portion 25 of the ribbon 26 remains free of glue and thus provides the lay fiat feature of the book binding illustrated in FIGS. 1 and 2.

Woven tabbed polyester ribbon of this invention may alternatively be heat treated to render it resistant to the penetration of adhesives.

The same adhesives which are used to join the sheets 16 to the book block may also be used to attach the book block 14 to the ribbon 26 or a second layer of adhesive may be used.

In addition to the more secure attachment of the book block 14 to the cover 12, the tabbed tubular ribbon 26 also provides a flexible binding which does not increase in stiffness appreciably when glue is applied. The tabbed ribbon tube 26 is preferably woven of a plastic material that will work compatibly with different types of glue and thus be able to attach well to both the preferred rough surface of the book block 14 and the normally smooth inside surface of the cover 12. The final product is a book which has a cover spine 20 that is stiff and a book block back 32 that is flexible because of its separation from the cover by the hollow tube 25 of the ribbon 26. The back 32 of the book block 14 is flexible because it is attached to the surface of the woven tubular ribbon 26 which is very flexible. Thus the tabbed tubular ribbon 26 provides not only the advantages of the woven tubular binding: an easy open lie flat book; but provides improved bonding to the cover, thereby producing a more durable, long-lasting book.

An important consideration in choosing the weaving specification of a particular tubular ribbon is that the surfaces of the ribbon should have yarn spacing which is wide enough to provide good glue adhesion for the particular adhesive to be employed, yet not be such an open weave that there will be strike-through of the adhesive onto the opposed interior surface of the ribbon resulting in the ribbon being glued to itself.

The ribbon is preferably made of fibers of polyester, which have both high tensile strength, high flexure strength and flexure modulus. This high strength in tension and in flexure allows the woven tubular binding of this invention to form a resilient durable hinge between the book back and the cover even when the outside diameter of the tubular binding has been completely coated with glue. Polyester also has a high heat deflection temperature which is required to be compatible with certain hot melt glues.

Yarns of other synthetic fibers such as nylon, polypropylene, acetate and others may be employed, depending on economic factors and the strength required for a particular binding application.

Likewise, in certain applications it may be appropriate to utilize woven tabbed tubular ribbons of natural fibers.

Thus the tubular woven polyester ribbon achieves sufficient strength to form a flexible hinge after the glue has flexed or creased when the book is opened. Even though covered with glue, the woven ribbon retains its flexibility. There is no need to leave a glue-free zone for purposes of forming a hinge. The woven tabbed tubular ribbon binding of this invention is also advantageous in the continuous production of books on an assembly line. As the ribbon is supplied to the spine of the cover as a preformed tube, no step is required in binding to create the tube. Furthermore, a plastic tubular ribbon may be effectively cut with a hot knife which does not require an opposing member, providing for efficient separation of the continuous ribbon into portions on each cover.

In manufacturing a quantity of books 10 the woven tabbed tubular ribbon 26 is fed from a spool. The tubular portion 25 of woven ribbon 26 is preferably the same width as the book block but because of the extending tabs 27, 29 may be somewhat narrower than the book block 14. Because the width of the book block varies between different books, the tabs provide a substantial advantage by allowing a range of widths to be accommodated by a single tabbed tubular ribbon.

It should be noted that lead times for the production of a tabbed tubular ribbon can be considerable, due to the specific set up of the complex weaving apparatus to produce a tabbed tubular ribbon of particular dimensions. Hence, the book binding of this invention makes it possible to bind many different editions of books of varying width using only a limited number of different width ribbons. It will be appreciated that a book block which is wider than the tubular portion 25 of the tubular ribbon 26 will be adhesively attached to the tabs 27, 29. Such an attachment will have only a minimal impact on the ability of the book to lie flat, and, so long as the book block does not fully cover the tabs, it will still provide the strengthened binding desired.

In manufacture of the book of this invention, the covers are preferably fed singly into a stream to receive the tubular ribbon. A hot melt Adhesive 36 such as Croda #10-24-5 is first applied to the second longitudinal section 30 of the ribbon 26. The ribbon is then attached to a cover 12. Each cover is separated using a hot knife to cut through the ribbon tube.

The adhesive 38 is applied onto the book blocks 14 which have been prepared on a conventional binding line, as described above, and the book blocks are then adhesively attached to the woven tubular ribbons 26 which have been attached to the covers 12.

It should be understood that the construction, fiber type, yarn size, yarn density, tube width, and tab width can be adjusted to achieve optimal performance for a particular application.

For example, although the tabs are schematically illustrated in FIGS. 3 and 4 as having a plain weave construction which will allow for a minimum strike through, a pointed or herringbone weave will allow more strike through.

It should also be understood that the fibers may be polyester, nylon, natural or other types of fibers. The yarns made from the fibers may be a filament, a textured filament or spun. The yarn size can be varied. For instance, a fine denier catch cord minimizes a bump on one side of the fabric. Further, the warp yarn density of the tabs may be adjusted in relationship with the robe. For instance, the density of the warp yarns and the tabs may be one-half to one-quarter of the tube.

It should also be understood that the width of the tube can be adjusted, depending on the size of the books. Similarly, the size of the tabs can be adjusted from very narrow, approximately one-thirty-second of an inch, to very wide, up to two inches or more.

In an alternative process, the tubular ribbons may be attached first to the book blocks and then to the covers.

It should be noted that case bound books of this invention may be formed by attaching the tubular ribbon to the stiff board covers of a conventional case binding.

It is further understood that the invention is not confined to the particular construction and arrangement of parts herein illustrated and described, but embraces such modified forms thereof as come within the scope of the following claims.

I claim:

1. A bound book comprising:

a) a book block with a plurality of sheets joined together at their spine edges, the block having a back, the book block having a width;

b) a cover having an inner spine portion and portions adjacent to the inner spine portion; and c) a woven tabbed tubular ribbon having a tube portion defining a tube of a selected circumference with a first tab and a second tab integrally woven with the tube, the first tab and second tab being about 180 degrees apart, wherein the tube and the tabs have interwoven warp yarns and filling yarn which present interstices for reception of adhesive, the tube circumference being no more than substantially twice the width of the book block, and wherein the tube has first and second circumferential sections, the first section being attached adhesively to the back of the block and the second section being attached adhesively to the inner spine portion of the cover, and the tabs being attached adhesively to the cover portions adjacent to the spine portion to prevent the tube from peeling away from the cover, the tube allowing the book block back to flex independently of the cover spine when the book is open so that the sheets of the open book will lie relatively flat.

2. The book of claim 1 wherein the tabs are between 1/32 inches and two inches wide.

3. The book of claim 1 wherein the yarns of the woven tabbed tubular ribbon are formed of fibers having a melting point of above 300° F.

4. The book of claim 1 wherein there are about 100 picks per inch per tab, about 50 picks per inch in the tube, about 203 warp yarns per inch in the tube and about 56 warp yarns per inch in the tabs.

5. A book comprising:

a) a plurality of paper sheets having spine edges, wherein the sheets are joined together along the spine edges to define a book block having an rearwardly facing, upwardly extending, back;

b) a cover having a spine defined between a front cover portion and a back cover portion; and b) a woven tabbed tubular ribbon, wherein the ribbon has an axially extending tube, and wherein a first tab extends sidewardly from the tube and is adhesively attached to the front cover portion, and a second tab extends sidewardly opposite the first tab and is adhesively attached to the back cover portion, wherein the first tab and the second tab are integrally woven with the tube, the tube and the tabs having interwoven warp yarns and filling yarn which present interstices for reception of adhesive, and wherein the tube has first and second circumferential sections defined between the first and second tab and respectively frontward and rearward of the tabs, the first section being attached adhesively to the spine, and the second section being attached adhesively to the book back, wherein the tabs restrict the tube from peeling away from the cover, the tube allowing the book block back to flex independently of the cover spine when the book is open so that the sheets of the open book will lie relatively flat.

6. The book of claim 5 wherein the tabs are about 180 degrees apart.

* * * * *